US007856768B2

(12) United States Patent
Riley

(10) Patent No.: US 7,856,768 B2
(45) Date of Patent: Dec. 28, 2010

(54) CITY ARRANGEMENT

(76) Inventor: Terrence P. Riley, 523 Lincoln, Pueblo, CO (US) 81004

( * ) Notice: Subject to any disclaimer, the term of this patent is extended or adjusted under 35 U.S.C. 154(b) by 285 days.

(21) Appl. No.: 11/776,824

(22) Filed: Jul. 12, 2007

(65) Prior Publication Data

US 2009/0018800 A1 Jan. 15, 2009

(51) Int. Cl.
*E02D 29/02* (2006.01)

(52) U.S. Cl. ..... 52/169.4; 52/169.3

(58) Field of Classification Search ..... 52/169.1–169.4, 52/174; 434/130, 131, 135, 139, 141, 146, 434/150–153; D25/3, 199
See application file for complete search history.

(56) References Cited

U.S. PATENT DOCUMENTS 1,784,728 A * 12/1930 Harriss ..... 404/1
2,241,830 A * 5/1941 Tourtellotte ..... 52/169.4
3,724,147 A * 4/1973 Levenson ..... 52/169.3
4,141,184 A * 2/1979 Vidal ..... 52/169.4
4,233,789 A * 11/1980 Dinardo ..... 52/169.2
4,679,363 A * 7/1987 Adams ..... 52/169.3
6,115,974 A * 9/2000 Milanian ..... 52/169.2

OTHER PUBLICATIONS

Wright, Ruth M. and Zegarra, Alfredo;The Machu Picchu Guidebook; Johnson Books; 2001 Edition; pp. viii, 2,7,34-35,66,77-78,98,103-104,113, Fold Out Map.*
My trip to Portugal—Oporto and the Duoro Valley, Nicos Neocleous, as show on website: <http://web.archive.org/web/20060523195052/http://www.wineloverspage.com/port/douro.phtml>.*

* cited by examiner

*Primary Examiner*—David Dunn
*Assistant Examiner*—Adam Barlow
(74) *Attorney, Agent, or Firm*—Mark G. Pannell; Pannell Law, LLC

(57) ABSTRACT

A city is arranged within a terraced valley. An agricultural realm, suitable for farming, is located on the valley floor. A civic concourse is on a terrace above the agricultural realm. The civic concourse has public buildings and a terrace of industries. The terrace of industries has manufacturing facilities. An automobile concourse is on a terrace above the terrace of industries. The automobile concourse has an avenue for automobile traffic. A market terrace is on a terrace above the automobile concourse. The market terrace has public market facilities. A residential terrace is no lower than the market terrace. The residential terrace has residences.

21 Claims, 7 Drawing Sheets

CITY ARRANGEMENT

BACKGROUND

There are by now millions of people living in unspeakable poverty in our developing nations. Of these millions, most live in the impoverished countrysides and many others live in the overcrowded cities. Water contamination is prevalent in cities as the same water is used by agriculture and industry and then used as drinking water. This often occurs because cities evolve and grow without a plan for development.

DETAILED DESCRIPTION

Figure 1:
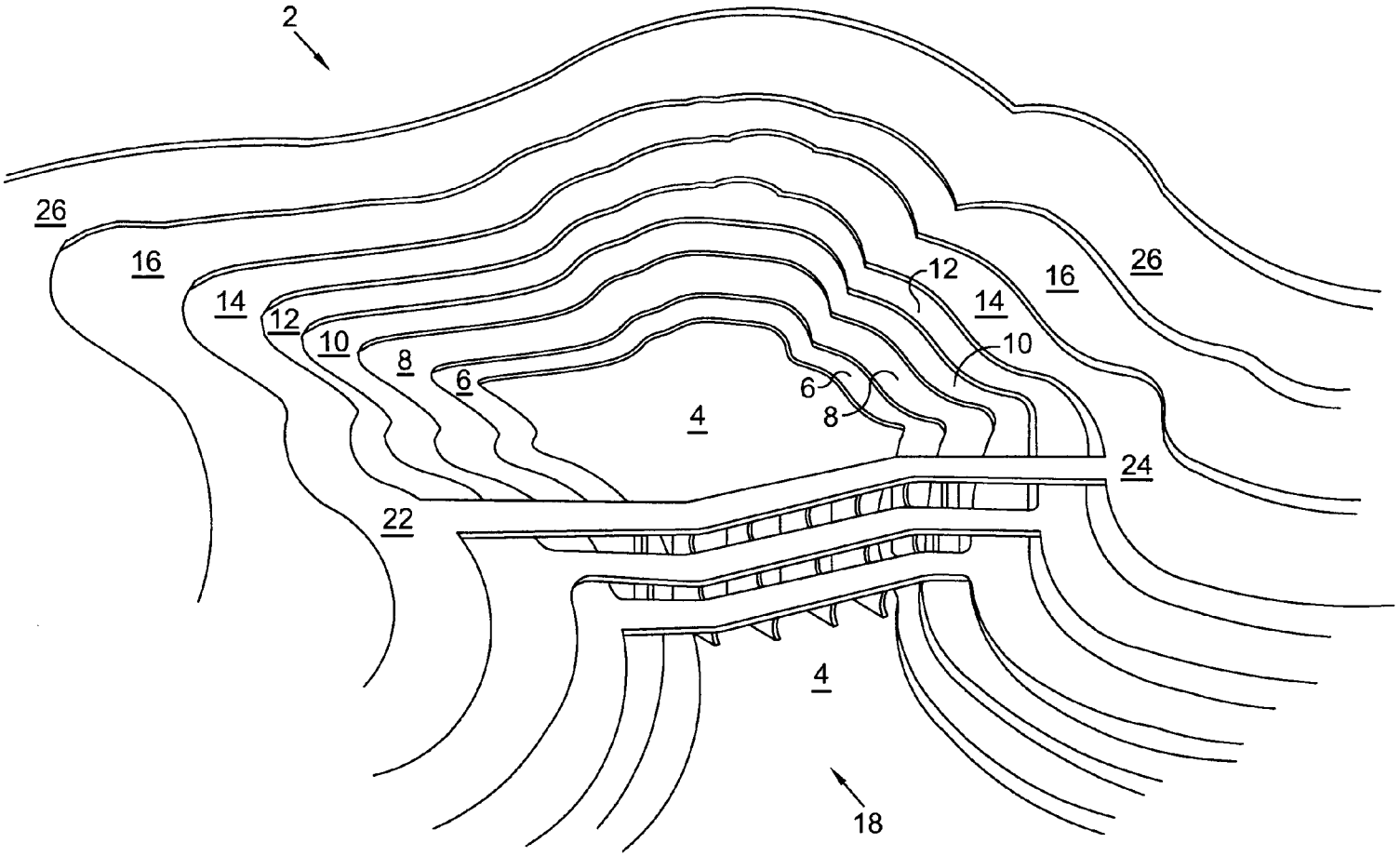
FIG. 1 is an orthogonal diagram of one embodiment of the present invention city arrangement.
Figure 2:
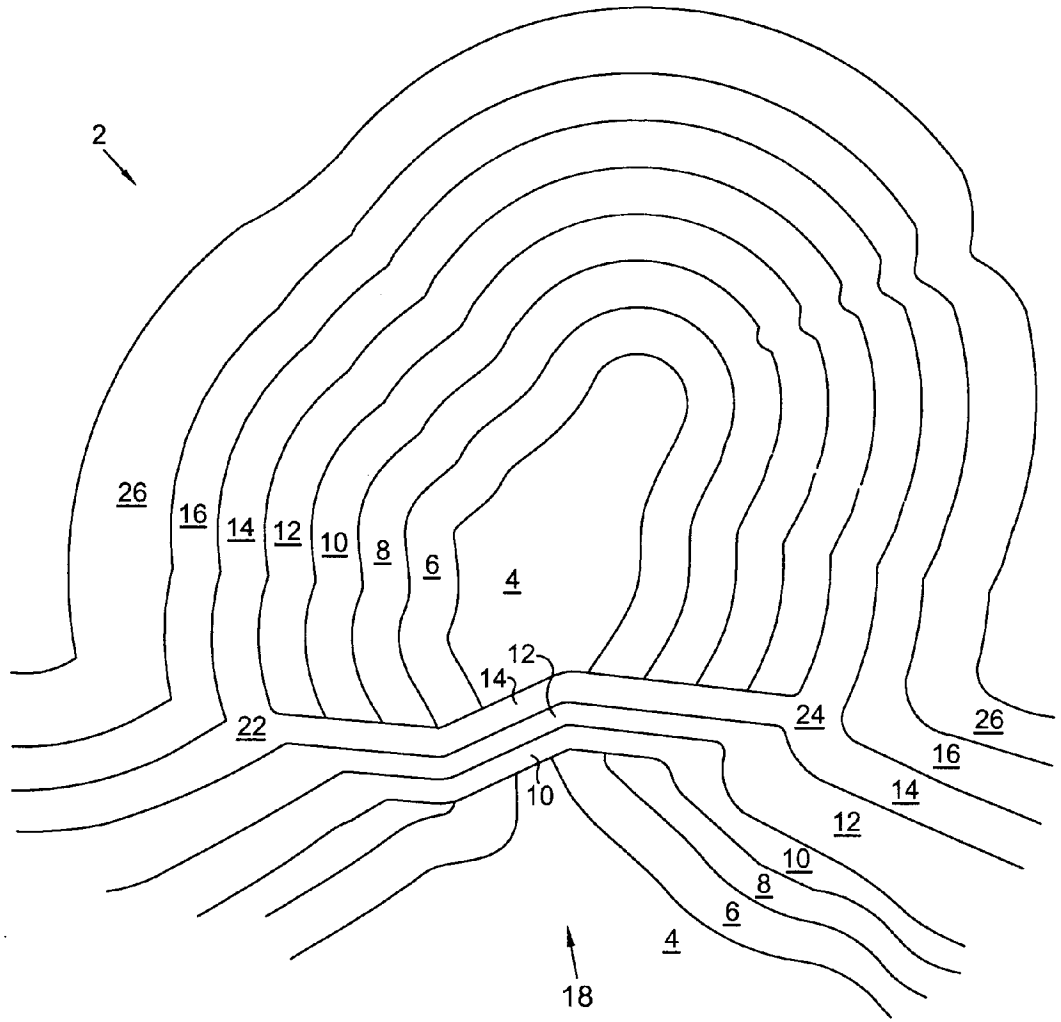
FIG. 2 is a top elevation diagram of the city arrangement of FIG. 1
Figure 3:
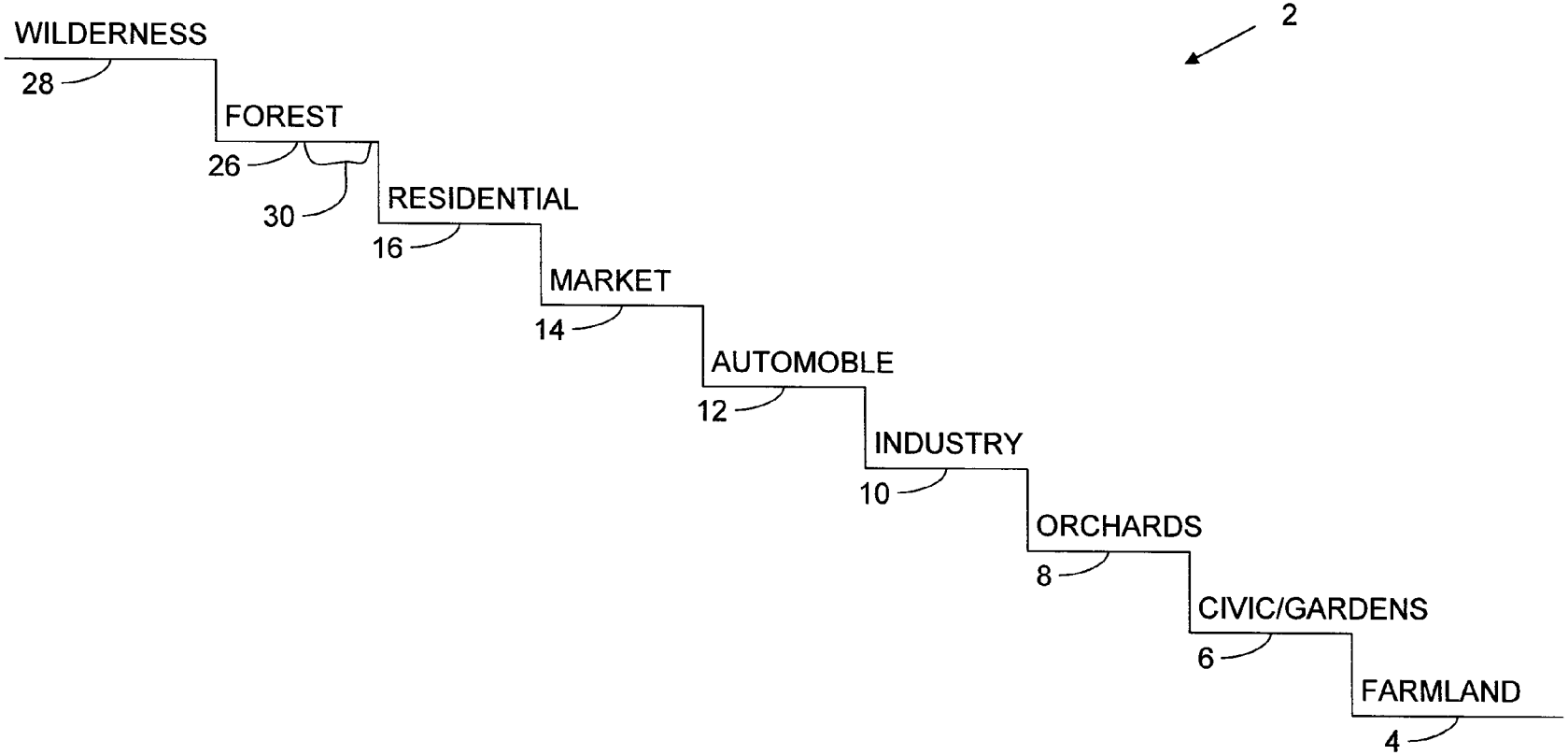
FIG. 3 is a cross-sectional illustration of the city arrangement of FIG. 1.
Figure 4:
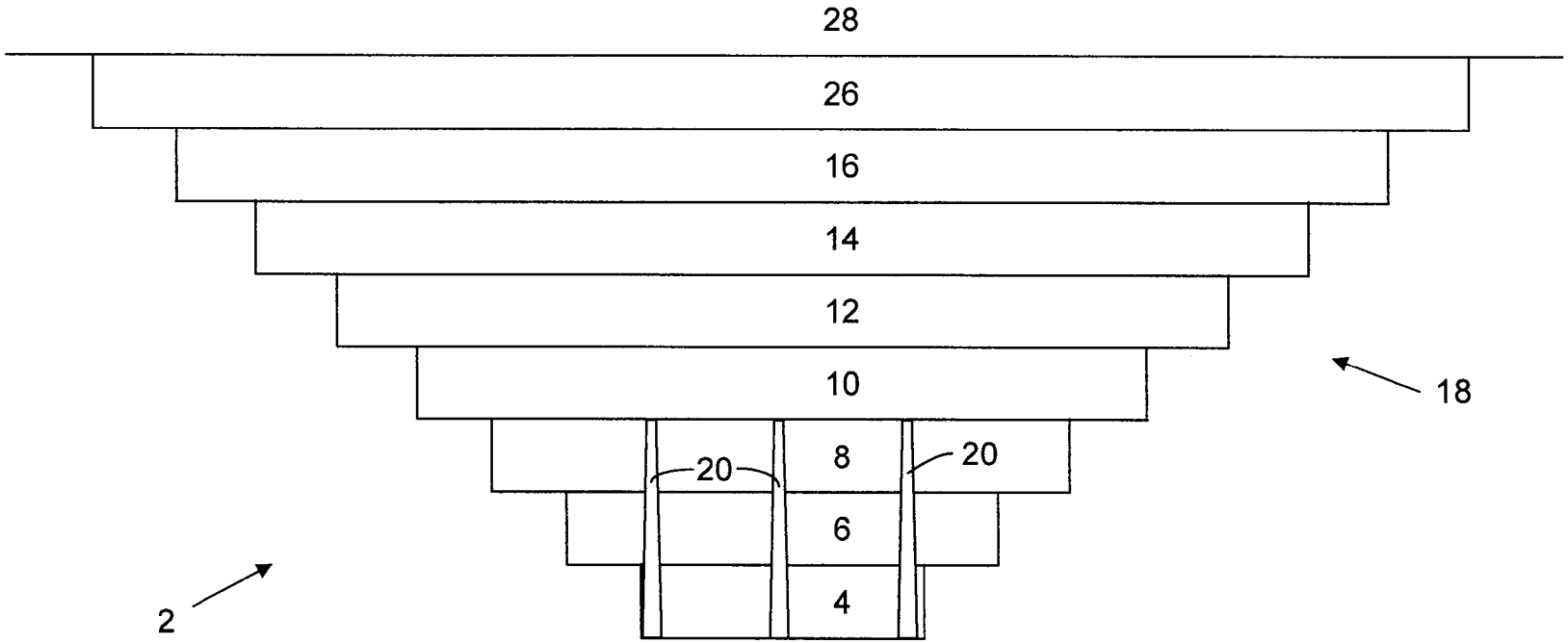
FIG. 4 is another cross-sectional view of the city arrangement of FIG. 1.

FIGS. 1-4 illustrates an embodiment of city arrangement 2. In this embodiment, city arrangement 2 is laid out within a terraced valley and includes agricultural realm 4, civic concourse 6, automobile concourse 12, market terrace 14, and residential terrace 16. Each of these terraces and concourses is represented as a single terrace, but alternatively includes multiple terraces or parts thereof. Surrounding city arrangement 2 is wilderness 28.

Agricultural realm 4 is farmland or land suitable for farming. In one embodiment, agricultural realm 4 includes the valley floor and extends from hillside to hillside. In one embodiment, agricultural realm 4 includes a lace of unpaved country lanes for foot traffic, work animals, and farm equipment. Agricultural realm 4 may also include the places for bringing in the harvest, recycling, salvage, granaries, the care of work animals, waste management staging, and the basic utilities for water reclamation and ethanol production.

Civic concourse 6 is a terrace for public buildings and free enterprise. Civic concourse 6 is on a terrace above agricultural realm 4. Civic concourse 6 provides spaces for a multitude of buildings. Example of the type of building in civic concourse 6 include workplaces, office connections, cafes, public restrooms, public baths, meeting halls, schools, newspapers, medical facilities, public services, and libraries. In one embodiment, civic concourse 6 further includes public and private gardens.

In one embodiment, an environmental curtain wall creates a continuous atrium around civic concourse 6. The atrium space encloses a temperate atmosphere between its own environmental curtain wall and the urban main body. Open and social by nature, it extends a string of civic facilities upward and outward from the ground to the enclosing automobile concourse 12, above. Civic concourse 6 is the urban realm's pedestrian and bicycle connection to the wider farming districts from an inner urban circulation realm of bike ramps and sidewalks.

In a further embodiment, civic concourse 6 includes terrace of industries 10. Terrace of industries 10 is reserved for industry and its operations and extends outward into the landscape. In one embodiment, terrace of industries 10 is a thousand meter terrace. In one embodiment, terrace of industries 10 is on a terrace above civic concourse 6. In another embodiment, terrace of Industrial 10 is directly below automobile concourse 12. Terrace of industries 10 includes manufacturing facilities and in one embodiment, terrace of industries 10 further includes loading docks, freight elevators, and warehousing facilities. In one embodiment, terrace of industries 10 includes a continuum of open and unencumbered spaces to fulfill the needs of a vigorous and modern industrial realm. Terrace of industries 10 establishes the industrial connection to the world at large.

Automobile concourse 12 provides an avenue for all kinds of traffic in the city. For example, automobile concourse 12 includes an avenue for automobile traffic. In one embodiment, automobile concourse 12 resides on its own wide terrace above terrace of industries 10 and traverses from hillside to hillside. Automobile concourse 12, in its width and prominence, protects the valley's agriculture, below, from encroachments and separates residential terrace 16, above, from its traffic. In one embodiment, the avenue for automobile traffic separates market terrace 14 from terrace of industries 10. Automobile concourse 12 is the place where shipping and loading coincide with terrace of industries 10, just below. In one embodiment, automobile concourse 12 is additionally the place where automobile needs are provided for; automobile repair, open street and underground parking, automobile servicing facilities, and automobile rentals. Automobile concourse 12 is the city's transportation connection to the world at large.

In one embodiment, a bridge 18 spans the valley. Supports 20 for bridge 18 may rest on the terraces below bridge 18. In one embodiment, portions of civic concourse 6, automobile concourse 12, and market terrace 14 are embodied on bridge 18 so that civic concourse 6, automobile concourse 12, and market terrace 14 bridge across the valley.

Market terrace 14 is a terrace having public market facilities. Market terrace 14 is on a terrace above automobile concourse 12. In one embodiment, market terrace 14 is the uppermost level of the civic/urban realm. In one embodiment, it extends across the civic architecture in a promenade formation from a court of oranges 22 to a court of tangerines 24.

Residential terrace 16 is no lower than market terrace 14. In one embodiment, residential terrace 16 shares a terrace with market terrace 14 and extends upward. Residential terrace 16 is where the residences are located. This is the place of living in close scale with neighbors, tree lined streets, and vegetable gardens. It is the place of repose and children's play.

In one embodiment, city arrangement 2 further includes terrace of orchards 8 having at least one orchard. Terrace of orchards 8 resides between civic concourse 6 and terrace of industries 10.

In one embodiment, city arrangement 2 further includes forest realm 26 on a terrace above residential terrace 16. Reforestation takes place here as needed to balance the civic demand of renewable resources. Forest realm 26 includes reservoirs 30, or Pools of Solomon, for holding water for use in the city below.

Figure 5:
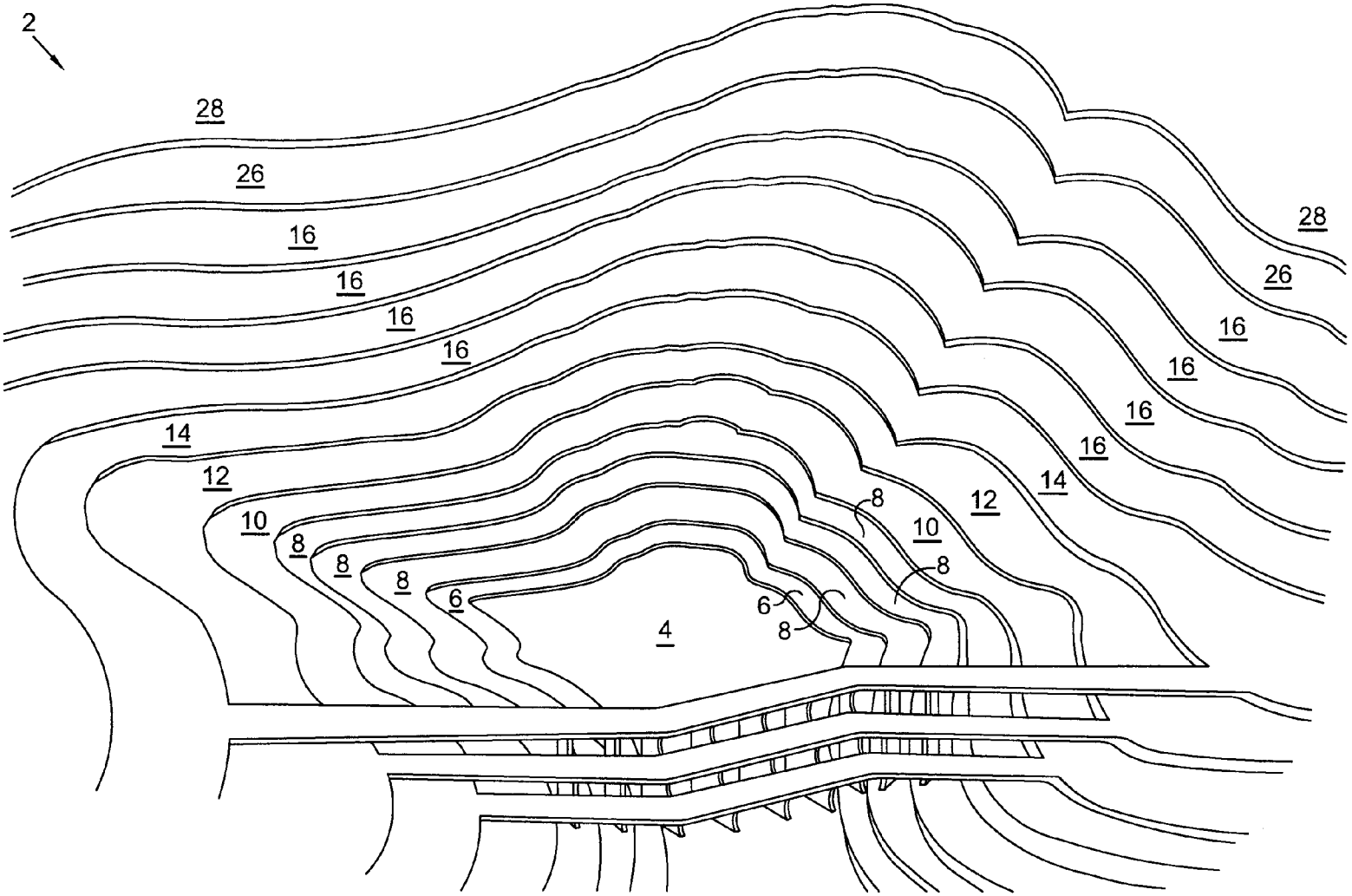
FIG. 5 is an orthogonal diagram of another embodiment of the present invention city arrangement.
Figure 6:
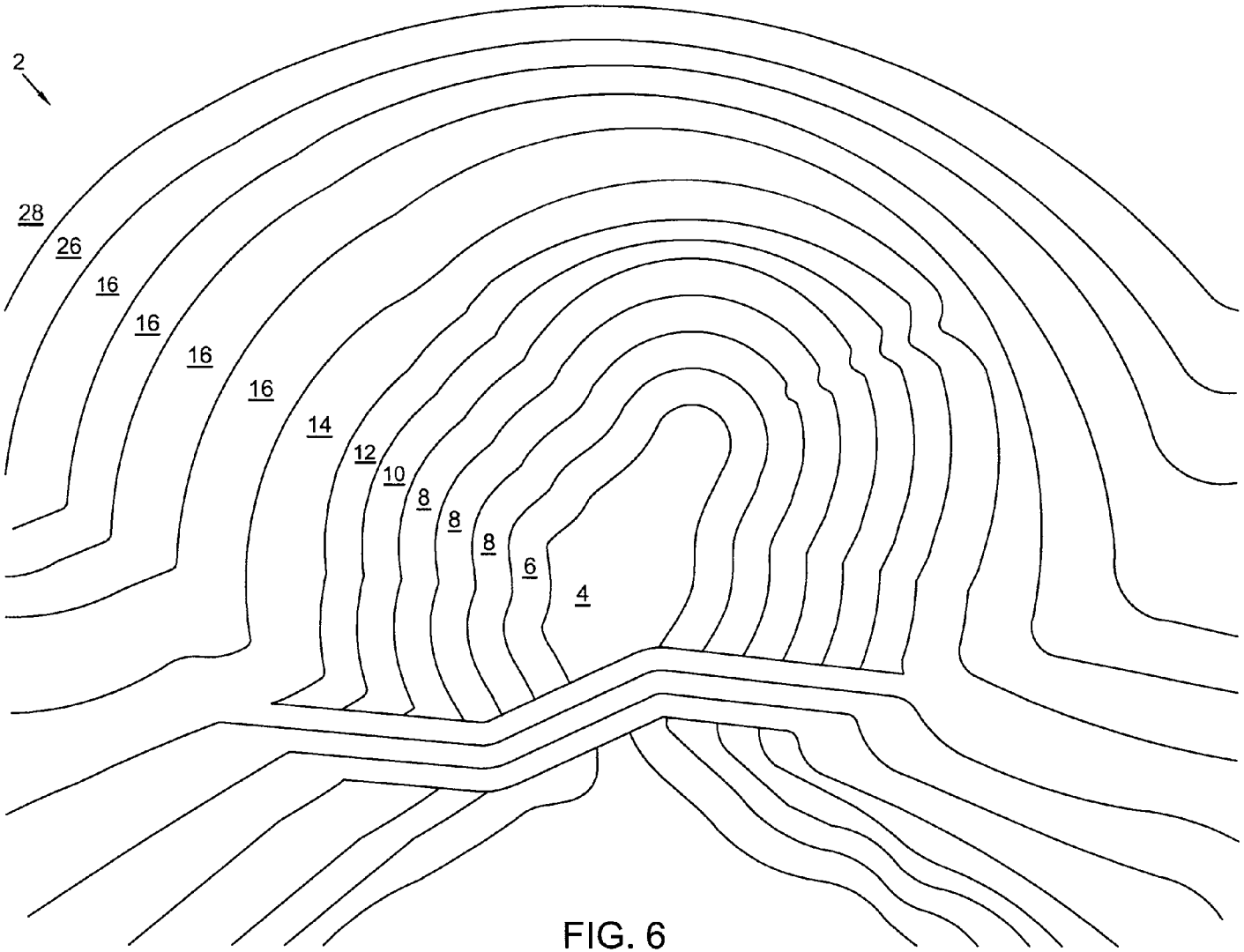
FIG. 6 is a top elevation diagram of the city arrangement of FIG. 5
Figure 7:
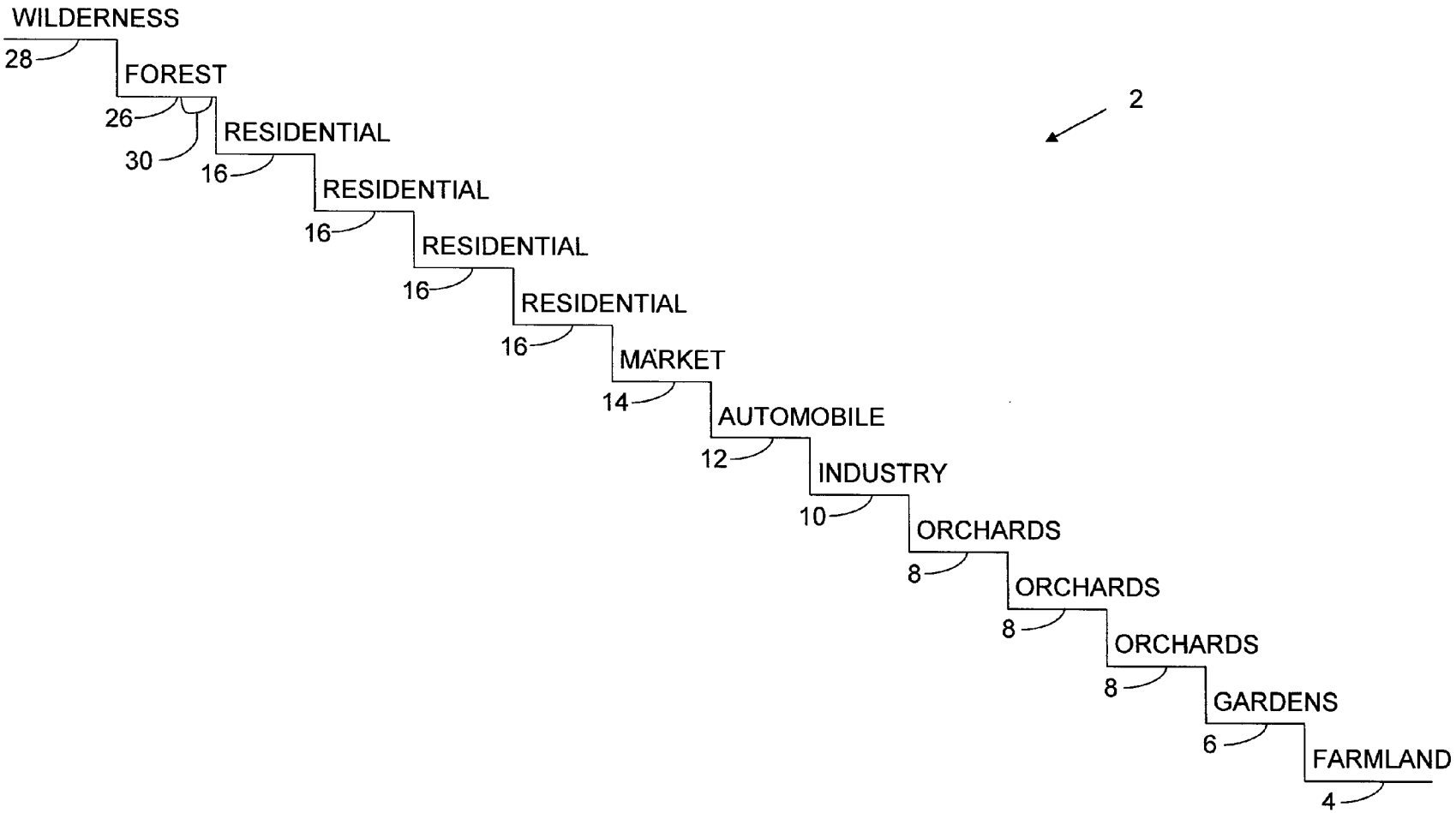
FIG. 7 is a cross-sectional illustration of the city arrangement of FIG. 5.

FIGS. 5-7 illustrates a more complex embodiment of city arrangement 2 wherein many of the levels of the city are embodied on multiple terraces. For example, terrace of orchards 8 is embodied on three terraces between civic concourse 6 and terrace of industries 10. Also, residential terrace 16 is embodied on four terraces between market terrace 14 and forest realm 26.

The foregoing description is only illustrative of some embodiments. Various alternatives and modifications can be devised by those skilled in the art without departing from the claimed subject matter. Accordingly, the claimed subject matter embraces all such alternatives, modifications, and variances.

What is claimed is:

1. A city arrangement within a terraced valley having a plurality of terraces, the city arrangement comprising:

a civic concourse on one of the plurality of terraces and defined by having public buildings;

an automobile concourse on one of the plurality of terraces above the civic concourse, the automobile concourse defined by having an avenue for automobile traffic;

a market terrace on one of the plurality of terraces above the automobile concourse, the market terrace defined by having public market facilities;

a residential terrace on one of the plurality of terraces no lower than the market terrace, the residential terrace defined by having residences; and wherein at least one of the civic concourse, automobile concourse, and market terrace both extends continuously around the terraced valley and bridges across the terraced valley to interconnect two points on the same terrace that extends around the terraced valley.

2. The city arrangement of claim 1 wherein the civic concourse further includes public gardens.

3. The city arrangement of claim 1 wherein the civic concourse further includes a terrace of industries having manufacturing facilities.

4. The city arrangement of claim 3 wherein the terrace of industries further includes warehousing facilities.

5. The city arrangement of claim 1 wherein the automobile concourse further includes automobile servicing facilities.

6. The city arrangement of claim 1 wherein the avenue for automobile traffic separates the market terrace from the civic concourse.

7. The city arrangement of claim 1 further including an agricultural realm suitable for farming, the agricultural realm below the civic concourse.

8. The city arrangement of claim 1 further including a terrace of orchards having at least one orchard.

9. The city arrangement of claim 1 further including a forest realm on a terrace above the residential terrace, the forest realm having reservoirs for holding water.

10. The city arrangement of claim 1 further including a court of oranges and a court of tangerines on opposite sides of the market terrace.

11. The city arrangement of claim 1 further wherein the civic concourse, automobile concourse, market terrace, and residential terrace are each disposed on all sides of the terraced valley.

12. A city arrangement within a terraced valley having a plurality of terraces, the city arrangement comprising:

public buildings on one of the plurality of terraces;

an avenue for automobile traffic on one of the plurality of terraces above the public buildings;

public market facilities on one of the plurality of terraces above the avenue for automobile traffic;

residences on one of the plurality of terraces no lower than the public market facilities; and wherein at least one of the avenue for automobile traffic and the public market facilities both extends continuously around the terraced valley and bridges across the terraced valley to interconnect two points on the same terrace that extends around the terraced valley.

13. The city arrangement of claim 12 further including public gardens on the terrace with the public buildings.

14. The city arrangement of claim 12 wherein the public buildings include manufacturing facilities.

15. The city arrangement of claim 12 wherein the public buildings include warehousing facilities.

16. The city arrangement of claim 12 wherein the automobile concourse further includes automobile servicing facilities.

17. The city arrangement of claim 12 wherein the avenue for automobile traffic separates the public market facilities from the public buildings.

18. The city arrangement of claim 12 further including an agricultural realm suitable for farming, the agricultural realm below the public buildings.

19. The city arrangement of claim 12 further including reservoirs for holding water on a terrace above the residences.

20. The city arrangement of claim 12 further including an orange grove and a tangerine grove on opposite sides of the public market facilities.

21. The city arrangement of claim 12 further wherein the public buildings, avenue for automobile traffic, public market facilities, and residences are each disposed on all sides of the terraced valley.

* * * * *